US006557367B1

(12) United States Patent
Lang et al.

(10) Patent No.: US 6,557,367 B1
(45) Date of Patent: May 6, 2003

(54) IMPINGEMENT COOLER WITH IMPROVED COOLANT RECYCLE

(75) Inventors: Gary Dee Lang, Naperville, IL (US); Yeu-Chuan Simon Ho, Naperville, IL (US); Theodore Hall Gasteyer, III, Naperville, IL (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 10/109,138

(22) Filed: Mar. 28, 2002

(51) Int. Cl.[7] ..... F25D 25/04
(52) U.S. Cl. ..... 62/380; 62/63
(58) Field of Search ..... 62/63, 373, 378, 62/380

(56) References Cited

U.S. PATENT DOCUMENTS

| | | | | |
|---|---|---|---|---|
| 1,930,414 A | * | 10/1933 | Buhr | 62/380 |
| 2,494,864 A | | 1/1950 | Erickson | 62/104 |
| 3,267,585 A | | 8/1966 | Futer | 34/20 |
| 3,864,931 A | | 2/1975 | Guttinger | 62/63 |
| 3,871,190 A | | 3/1975 | Harper et al. | 62/380 |
| 3,898,863 A | | 8/1975 | Wagner | 62/208 |
| 4,077,226 A | | 3/1978 | Strong | 62/63 |
| 4,175,396 A | | 11/1979 | Miller et al. | 62/63 |
| 4,462,383 A | | 7/1984 | Henke et al. | 126/21 |
| 4,474,498 A | | 10/1984 | Smith | 432/144 |
| 4,479,776 A | | 10/1984 | Smith | 432/144 |
| 4,481,782 A | | 11/1984 | Mukerjee | 62/63 |
| 4,523,391 A | | 6/1985 | Smith et al. | 34/225 |
| 4,783,972 A | | 11/1988 | Tyree, Jr. et al. | 62/374 |
| 4,852,358 A | * | 8/1989 | Acharya et al. | 62/63 |
| 4,912,943 A | * | 4/1990 | Hubert et al. | 62/63 |
| 4,947,654 A | | 8/1990 | Sink et al. | 62/186 |
| 4,955,206 A | | 9/1990 | Lang et al. | 62/186 |
| 5,123,261 A | | 6/1992 | Cope | 62/374 |
| 5,168,711 A | | 12/1992 | Moore et al. | 62/63 |
| 5,365,752 A | | 11/1994 | Coffre | 62/374 |
| 5,408,921 A | | 4/1995 | Persson et al. | 99/443 |
| 5,444,985 A | | 8/1995 | Lang et al. | 62/63 |
| 5,467,612 A | | 11/1995 | Venetucci | 62/374 |
| 5,474,794 A | | 12/1995 | Anderson et al. | 426/614 |
| 5,509,277 A | | 4/1996 | Kiczek et al. | 62/374 |
| 5,606,861 A | | 3/1997 | Renz | 62/63 |
| 5,694,836 A | | 12/1997 | Blevins | 99/517 |
| 5,715,688 A | | 2/1998 | Jones, III | 62/63 |
| 5,740,678 A | | 4/1998 | Lee et al. | 62/63 |
| 5,765,394 A | | 6/1998 | Rhoades | 62/603 |
| 5,868,003 A | | 2/1999 | Simas et al. | 62/603 |
| 6,334,330 B2 | | 1/2002 | Lang et al. | 62/374 |

FOREIGN PATENT DOCUMENTS

| | | |
|---|---|---|
| EP | 0089762 | 9/1983 |
| EP | 1164653 | 6/1999 |
| FR | 975566 | 3/1951 |
| WO | WO 9849505 | 11/1998 |
| WO | WO 0042869 | 7/2000 |

OTHER PUBLICATIONS

Ovidia, David Z. et al. "Impingement in Food Processing", Food Technology, vol. 52, No. 4, pp 46–50 (Apr. 1998).

* cited by examiner

*Primary Examiner*—Ronald Capossela
(74) *Attorney, Agent, or Firm*—Donald T. Black

(57) ABSTRACT

An impingement cooler or freezer includes at least one impingement section, having a plurality of channeling means defining apertures enabling cooling fluid impingement flow toward and onto objects on a conveyor and defining a channel through which the cooling fluid from the objects flows into a duct which carries the fluid to a unit that chills the fluid, and includes passage means which receives cooling fluid from said apertures and lets it enter the duct after having flowed toward and onto said objects, the fluid being impinged and recirculated by a fan.

10 Claims, 4 Drawing Sheets

IMPINGEMENT COOLER WITH IMPROVED COOLANT RECYCLE

FIELD OF THE INVENTION

The present invention relates to coolers and particularly to cooling and freezing tunnel systems that impinge coolant onto a product for accelerated cooling and freezing thereof.

BACKGROUND OF THE INVENTION

Many industries, not least among them the food industry, find it necessary in the course of their operations to be able to chill or freeze products relatively rapidly. Whether the product needing chilling or freezing is at room temperature, or is at temperatures higher than room temperature as the result of a previous processing or cooking step, reducing the temperature of the product rapidly is desirable in order to minimize the ability of pathological organisms such as bacteria to grow on or in a product, and (particularly when the product is to be frozen), to put the product into condition to be packaged prior to its being stored and/or shipped to distributors or customers. Examples of products which benefit from this treatment, which are also products that can be treated by the present invention, include raw foods such as eggs, hamburger patties, fruits and vegetables, raw or cooked cuts of meat such as beef, pork, veal, lamb, poultry carcasses and poultry sections, as well as processed foods prepared by combining various ingredients, such as pastries, pre-packaged entrees and complete dinners.

Many techniques are known for cooling and freezing such products. Examples include impingement coolers, mechanical refrigerators, and other devices wherein the product is conveyed through a chamber wherein the product is exposed to low temperatures for a sufficient period of time to reduce the temperature of the product to the desired final, cooled temperature.

Impingement coolers are one satisfactory mode for providing the desired rapid cooling or freezing. However, to date they have suffered from various drawbacks to completely efficient operation. In particular, the cold air or other coolant after it is impinged upon the product is either wasted or is recovered, recooled and recirculated to be impinged again upon additional product via structural configurations that interfere with the ability to provide satisfactory impingement upon the product for a suitable distance and length of time.

Thus, there remains a need for a device that provides more efficient impingement cooling and freezing, without unduly increasing the size of the apparatus employed to achieve a given amount of cooling or freezing.

BRIEF SUMMARY OF THE INVENTION

One aspect of the present invention is a cooling tunnel comprising:

(A) conveyor means for carrying objects through said cooling tunnel;

(B) refrigeration means for receiving cooling fluid, chilling it, and providing chilled cooling fluid into said tunnel;

(C) at least one impingement section means extending along a portion of the length of said conveyor means within said cooling tunnel, there being one or more regions along the length of said conveyor means within said cooling tunnel along which no impingement section means extends, each impingement section means comprising a plurality of channeling means arrayed parallel to the direction of motion of said conveyor means, adjacent ones of said channeling means defining therebetween an aperture for enabling cooling fluid to flow through said aperture toward and onto objects on said conveyor means, wherein said aperture is on an axis parallel to the direction of motion of said conveyor means, each said channeling means defining with said conveyor means a channel for receiving cooling fluid that has passed through an aperture onto said objects and for enabling said cooling fluid to flow into one or more of said regions;

(D) duct means for enabling flow of cooling fluid from one or more of said regions to said refrigeration means;

(E) passage means in fluid communication with an aperture and extending from said aperture into or across one of said regions, for enabling cooling fluid that enters said passage means from said aperture to enter said duct means after having flowed out of said passage means toward and onto said objects; and (F) fan means for causing flow of said cooling fluid from said refrigeration means through an aperture with sufficient velocity to impinge upon and cool said objects and to recirculate said cooling fluid through said duct means to said refrigeration means.

DETAILED DESCRIPTION OF THE INVENTION

Cooling tunnels in accordance with the present invention generally comprise an enclosure within which the other components reside and operate. A preferred embodiment is simply a box-shaped enclosure, preferably having insulated walls, ceiling and floor, and provided with an inlet opening for receiving product from outside the enclosure to be chilled or frozen, and provided further with an outlet opening through which chilled or frozen product emerges from the enclosure to the outside, where it can be taken away manually or conveyed to associated apparatus for receiving the product, packaging it, or the like. Preferably, controls for operating the apparatus and for monitoring its operation, as well as motors for driving the fan and the conveyor, are situated outside the enclosure; this is advantageous as it provides better access to these motors and reduces the need to use special cold-tolerant machinery.

Depending on the desired rate of production of chilled or frozen product, the enclosure and the apparatus within it can range in size from a few feet on a side to being large enough for adults to step into the enclosure and stand inside it comfortably. Regardless of the overall size, it can be convenient to have several units comprising the present invention end-to-end and/or side-by-side within the enclosure. As will be seen hereinbelow, when cold air or other vapor is used as the cooling fluid, it is permissible for the cooling fluid to pass through the interior of the enclosure itself en route to the apertures through which the cooling fluid is impinged upon the product. Air is the preferred cooling fluid as it has no cost and can be chilled to sufficiently low temperatures to cool or freeze products.

Figure 1:
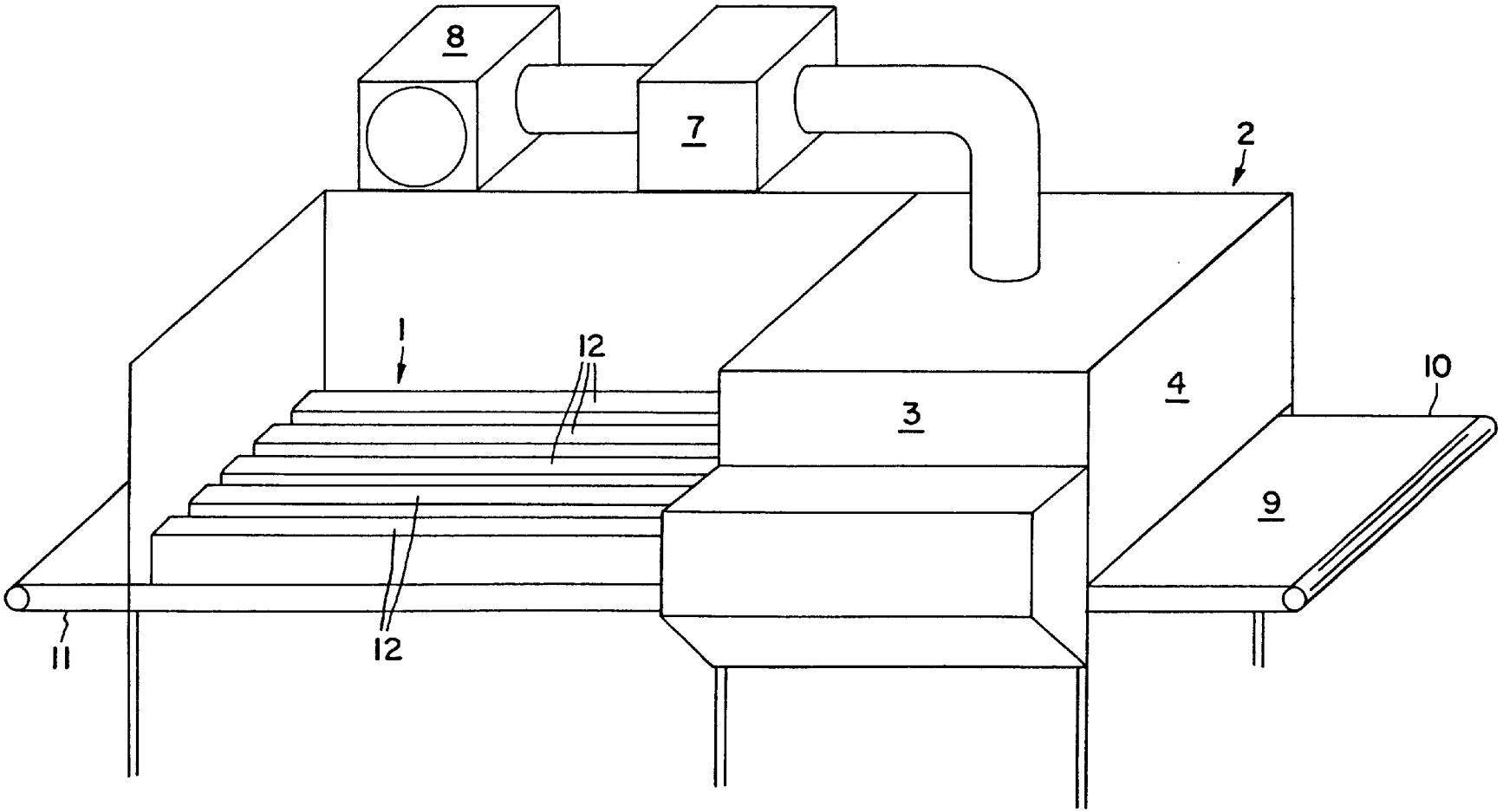
FIG. 1 is a perspective view of one embodiment of the present invention.

FIG. 1 shows one embodiment of the apparatus of the present invention, which in this embodiment contains one impingement section 1 and one adjacent duct 2. FIG. 1 shows front panel 3 and side panel 4 which are two of the panels that define duct 2. Another side panel 5, and a rear panel 6, visible in FIG. 2, cooperate with panels 3 and 4 to form duct 2.

Duct 2 carries cooling fluid away from the product after the cooling fluid has impinged upon the product. In the embodiment shown in FIG. 1, duct 2 carries cooling fluid to fan means 7. Fan means 7 draws the cooling fluid up through duct 2, into and through fan means 7, and into and through refrigeration means 8, from which chilled cooling fluid is expelled into the tunnel interior or is otherwise directed through piping (not shown) toward the apertures of the impingement section or sections.

Refrigeration means 8 comprises any conventional heat exchange device by which cooling fluid, such as air, passes through refrigeration means 8 and is chilled via indirect heat exchange by coming into contact with piping or other surfaces which are colder than the fluid entering into refrigeration means 8. One preferred technique is to contact the air with piping that contains mixed carbon dioxide-ammonia refrigerant, which is generally at −62° F. to −63° F., so that the air is chilled to about −52° F. to −53° F. Another preferred technique is to use as the refrigerant a multicomponent refrigerant such as disclosed in U.S. Pat. No. 6,176,102, which permits the cooling surfaces to have a temperature even as low as about −140° F. so that the air can be chilled to about −125° F.

It should be noted that it is also acceptable for purposes of this invention if refrigeration means 8 is positioned between the upstream end of duct 2 and the fan means 7, such that fan 7 pulls cooling fluid into and through refrigeration means 8.

Referring still to FIG. 1, conveyor 9 can be seen which in this embodiment is a belt which extends under the length of impingement section 1, under the lower end of duct 2 over which no impingement section extends, and which preferably extends at ends 10 and 11 beyond any impingement section and any duct thereby to facilitate depositing incoming product onto conveyor 9 at one of ends 10 and 11 and discharging chilled or frozen product off of conveyor 9 at the other of ends 10 or 11. Conveyor 9 can be driven by any conventional means known in the art, such as by an electric motor connected via a conventional drive belt to rollers at one or more ends of conveyor 9, or by toothed gears directly engaging suitable openings in conveyor 9 if conveyor 9 is in the form of an open mesh having openings adapted to engage the teeth of such gear means.

Conveyor 9 can be in the form of a conventional conveyor belt, as shown, and is preferably of an open construction that permits cooling fluid to pass through the conveyor that carries the product. In that way, cooling fluid can be impinged upon product that is carried along the top surface of the conveyor from both above and below the conveyor itself. Alternatively, conveyor 9 can comprise any structure, such as rollers, individual receptacles, or the like, capable of being moved and capable of carrying product past the one or more impingement sections and through the one or more ducts as described herein.

In the embodiment shown in FIG. 1, front panel 3 is configured to define a passageway by which cooling fluid that has been impinged upon the bottom surface of product can be collected and passed into duct 2 to be fed to the refrigeration means and fan. Front panel 3 can instead be a simple flat panel, if cooling fluid is to be impinged only onto the top of the product.

Figure 2:
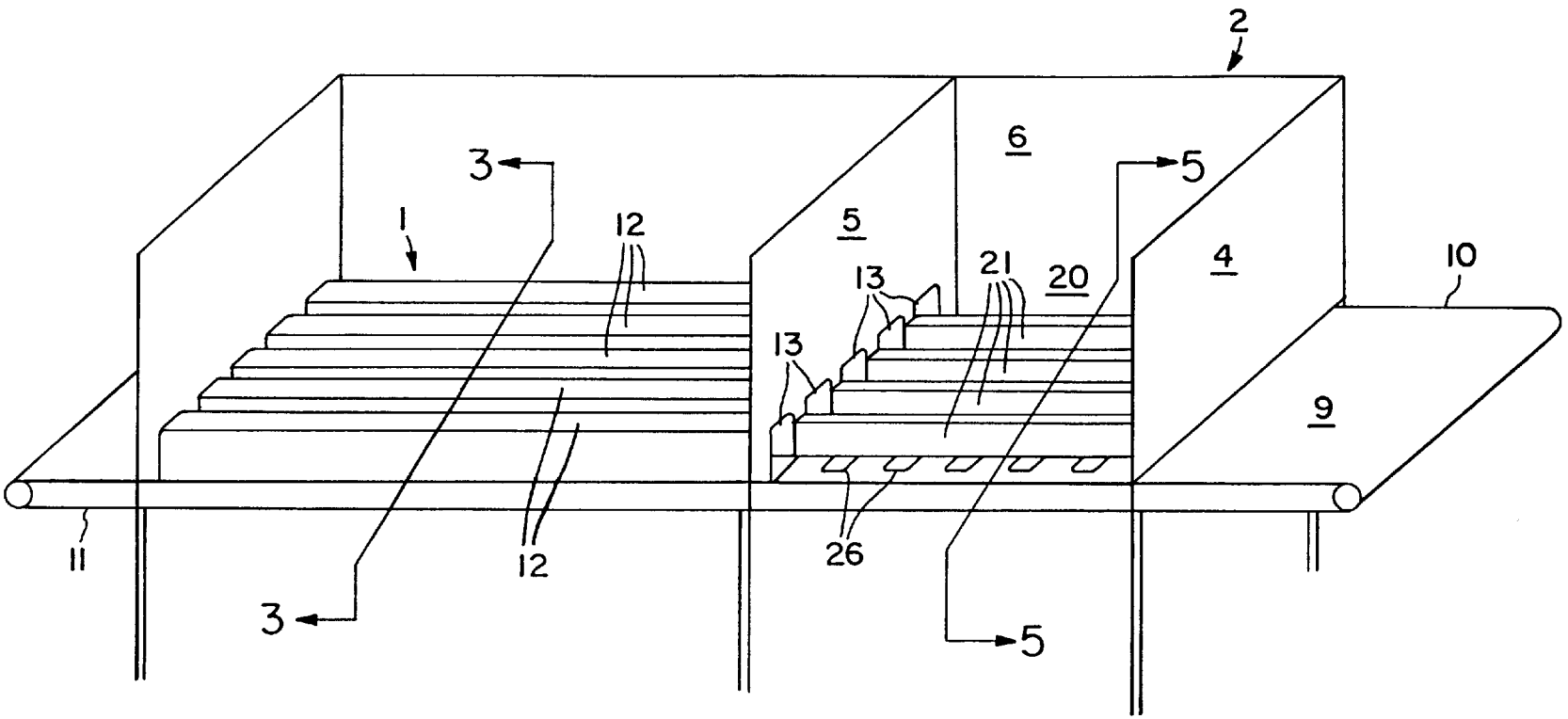
FIG. 2 is a perspective view of the interior of the embodiment of FIG. 1.

FIG. 2 is a view of the device shown in FIG. 1, but omitting the fan means 7, refrigeration means 8, and the associated ductwork connecting them. Front panel 3 is also omitted to assist description of significant structure inside the housing that forms duct 2. Side panel 5 and rear panel 6 of the duct 2 can be seen in this view.

As seen in FIG. 2, impingement section 1 comprises a plurality of channeling devices 12 each of which extends lengthwise in a direction parallel to the direction of motion of conveyor 9. Each channeling device preferably presents a concave surface toward the surface of conveyor 9. One or more impingement sections analogous to impingement section 1 can be provided below conveyor 9, thereby to impinge coolant upon the top and bottom surfaces of the products being cooled or frozen. However, FIG. 1 depicts an impingement section only above the conveyor 9, which is the preferred arrangement if there is to be impingement from only one side of the conveyor.

Each impingement section is associated with at least one duct such as duct 2 so that cooling fluid which has impinged upon product through an impingement section as described herein then flows into a duct and is then cycled by fan 7 through refrigeration means 8 to be used over again in impinging upon product. To enable cooling fluid to pass from impingement section 1 into duct 2, each channeling device 12 terminates at one or both of its ends in an opening 13 which communicates with region 20 in which no impingement section extends along the conveyor 9. Preferably, these openings 13 are all formed in a surface that helps define a wall of duct 2, such as panel 5 seen in FIG. 2.

The ends of each channeling device 12 at the end of the impingement section that does not adjoin a duct should be closed, as is the case in the embodiment shown in FIG. 2. If another duct is provided at that other end of the impingement section, then the associated ends of the channeling devices 12 can also be open to permit cooling fluid to flow into that duct as well. Preferably, though, the ends of the channeling devices 12 closest to an inner wall of the opening of the tunnel end about 5 inches short of that wall, the better to reduce air infiltration into the tunnel chamber. Air infiltration can cause icing on the refrigeration coil and/or the impingement slots. This preferred arrangement also permits operation at relatively constant ambient pressure minimizes structural loading due to pressure on the enclosure.

Figure 3:
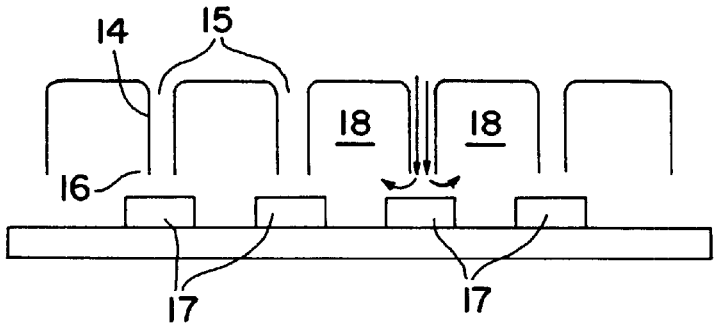
FIG. 3 is a cross-section view of the embodiment of FIG. 1, seen along the line 3–3' in FIG. 1 looking in the direction of the arrows on line 3–3'.

The configuration and positioning of the channeling devices 12 can be seen in more detail in FIG. 3. As seen in FIG. 3, the channeling devices 12 are arrayed side-by-side, preferably from one edge of conveyor 9 completely to the other edge of conveyor 9. Adjacent channeling devices 12 are positioned with respect to each other so as to form between them an aperture 15. Aperture 15 is dimensioned, in width (defined by the distance between the sides 14 of adjacent channeling devices 12) and depth (defined by the distance from the top of the aperture to the bottom edges 16 of adjacent channeling devices 12) so that cooling fluid drawn through the aperture impinges upon the top surface of product 17 passing under the aperture. The apertures can be of any shape that provides satisfactory direction and velocity of the cooling fluid onto the product, including shapes in which the sides 14 are roughly parallel to each other or converge toward each other in the direction of cooling fluid flow.

The arrows seen in FIG. 3 indicate the direction of flow of cooling fluid: through the aperture 15 toward the surface of product 17, then along the surface of product 17 in a direction transverse to the direction of motion of conveyor 9, whereupon the cooling fluid passes under the bottom edges 16 of the channeling devices 12 and enters into channels 18 defined by the respective concave surfaces of channeling devices 12. Under the influence of fan 7, the cooling fluid having entered channels 18 is then drawn along the length of the channeling devices 12 toward the open ends 13 of the channeling devices and thus into duct 2.

Figure 4:
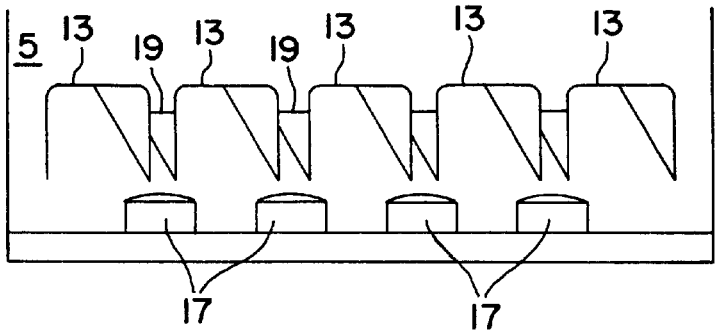
FIG. 4 is a view of the embodiment of FIG. 2, seen in a cross-section taken in the plane of surface 5 viewed from region 20 looking toward impingement section 1.

The present invention includes another feature which helps conserve cooling fluid and achieve a much more efficient usage of cooling fluid for a given size of device. That is, means are provided so that cooling fluid can be caused to impinge upon product carried on the conveyor even through the regions 20 communicating with duct 2 where there is no impingement section extending along the conveyor. Referring to FIG. 4, which is a view at the aforementioned side panel 5 looking into the openings 13 of the respective channeling devices 12, it can be seen that where impingement section 1 adjoins duct 2 the respective apertures 15 also end with openings 19 that would enable cooling fluid to pass from the apertures 15 into region 20, thereby to be drawn into duct 2 without first having impinged upon product on conveyor 9. To prevent this undesired loss of the cooling ability possessed by this cooling fluid, the present invention provides structure that contains the flow of cooling fluid emerging from the open ends 19 of apertures 15, and permits cooling fluid to enter into region 20 and thus into duct 2 after (and preferably only after) the cooling fluid has flowed onto the product 17 on conveyor 9, in this case in a downward direction.

Figure 5:
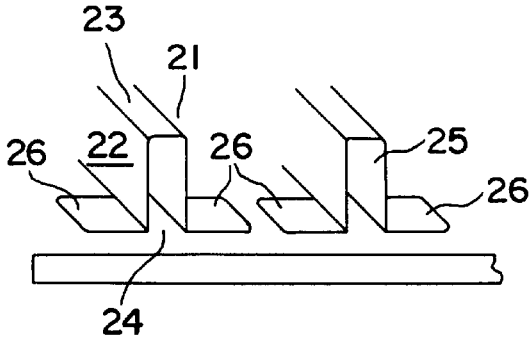
FIG. 5 is a cross-section view of the embodiment of FIG. 2, seen along the line 5–5' in FIG. 1 looking in the direction of the arrows on line 5–5'.

This structure can be seen in FIG. 1 and appears in greater detail in FIG. 5. The structure can be seen as segments 21 which have sides 22 and top 23 which confine the cooling fluid within segment 21. The segments 21 can present a more curved cross-sectional configuration, such as an inverted U, instead of the more angled embodiment shown in FIG. 5.

Segments 21 also have an open slot 24 on the face of segments 21 closest to conveyor 9. Segments 21 also have at least one open end 25 to communicate with the open end 19 of an aperture 15. Preferably, the connection between ends 19 and 25 prohibits any cooling fluid from escaping around the joint where the open end 25 meets the open end 19 of an aperture; but flow of cooling fluid through.this joint should at least be minimized. Thus, it is advantageous that the open end 25 of the segment 21 corresponds in shape, size and relative location so as to mate with the open end 19 of an aperture 15.

The end of each segment 21 that does not communicate with an end 19 of an aperture 15 can be closed, so that cooling fluid that has entered segment 21 through open end 25 can escape from segment 21 only by flowing through the slot 24 toward product on conveyor 9. Each segment 21 should extend parallel to the direction of motion of conveyor 9, and preferably extends all the way across the region 20 as defined herein where there is no impingement section. In this way, maximum usage is made of the ability of the cooling fluid to impinge upon and cool or freeze product on conveyor 9.

Figure 6:
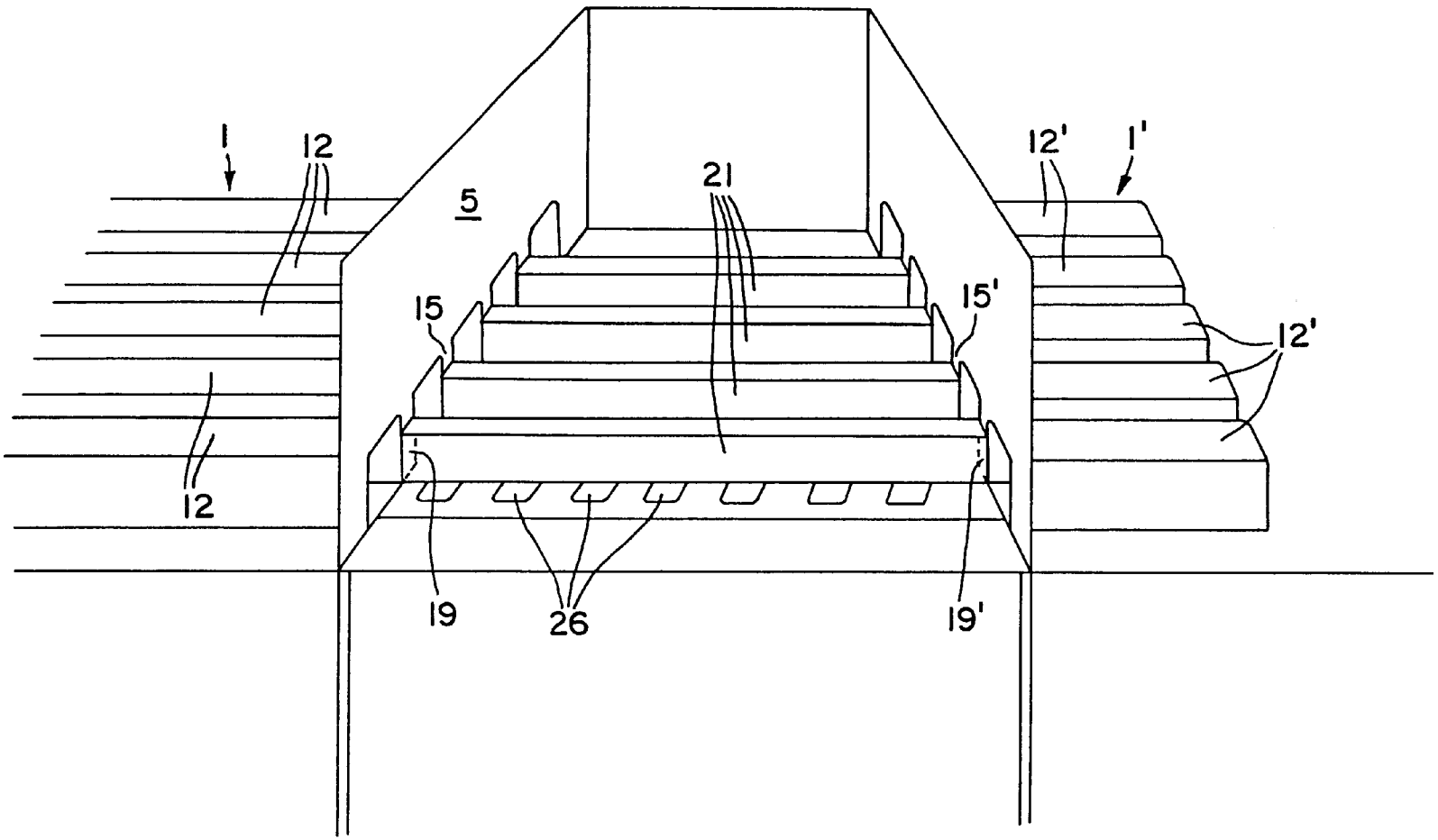
FIG. 6 is a perspective view of another embodiment of the present invention.

If the desired cooling and freezing demands warrant, a series of two or more impingement sections can be provided, wherein adjacent impingement sections are separated from each other by a duct 2 and wherein there is accordingly a corresponding region 20 wherein no impingement section extends along the conveyor 9. In such embodiments, it is preferred to provide that the segments 21 extend all the way across each such region 20 so that apertures in adjacent impingement sections can communicate with each other thereby providing an impinging flow of cooling fluid along the entire length of the conveyor 9 (excepting only ends 10 and 11 if present). Such an embodiment is shown in FIG. 6, in which reference numerals that are repeated from other figures have the meanings provided with respect to the other figures in which they appear. In FIG. 6, as in FIG. 2, the front panel that would be part of duct 2 is not shown, so that structure inside region 20 can be seen. The adjacent impingement sections 1 and 1' have channeling devices 12 and 12' presenting equal numbers of apertures 15 and 15' presenting openings 19 and 19', and that number of segments 21 is provided each of which connects one opening 19 with one opening 19' so that flow of cooling fluid is possible between impingement sections 1 and 1' across region 20.

Indeed, it has been found that impinging flow of cooling fluid onto product can be at its highest in the region or regions 20. In these cases, it is advantageous to provide retaining structure, such as plates 26 extending from each segment 21, to inhibit product that is passing along this portion of the conveyor from being dislodged or blown off of the conveyor by upward flow of cooling fluid, particularly by flow upward having a component perpendicular to the direction of motion of the conveyor.

In general, the distance between the conveyor 9 and the edges 16 of the channeling devices that closest to the conveyor 9 should be minimized, to provide better impingement and heat transfer at the product surface. It is also advantageous to be able to cool and freeze products having different sizes, or at least different heights measured from the conveyor surface. Thus, in another aspect of the invention, which is optional but preferred, provision can be made so that the distance between the conveyor 9 and the edges 16 of the channeling devices 12 closest to the conveyor 9 can be adjusted to be larger or smaller. The distance between the conveyor 9 and the bottom edges of segments 21 would also need to be adjustable. With this feature, the apparatus can be made to accommodate products of different sizes by simply adjusting that distance.

One way to provide this adjustability is to mount each impingement section and each set of segments 21 so that they can be shifted up or down with respect to the conveyor. Another way to provide this adjustability is to mount the apparatus that carries the conveyor so that that apparatus can be shifted up or down with respect to both the impingement section and the segments 21. The adjustable mounting can be provided by constructing the apparatus on a framework including vertical support poles, and providing that either the impingement section or the framework holding conveyor 9 is slidable upward and downward on the poles and can be clamped or bolted into each new position into which it has been moved.

The device as described herein can be constructed so that each impingement section, and the passage means provided by the segments 21, can be removed to facilitate accessibility to and cleaning of the components of the device.

What is claimed is:

1. A cooling tunnel comprising:

(A) conveyor means for carrying objects through said cooling tunnel;

(B) refrigeration means for receiving cooling fluid, chilling it, and providing chilled cooling fluid into said cooling tunnel;

(C) at least one impingement section means extending along a portion of the length of said conveyor means within said cooling tunnel, there being one or more regions along the length of said conveyor means within said cooling tunnel along which no impingement section means extends, each impingement section means comprising a plurality of channeling means arrayed parallel to the direction of motion of said conveyor means, adjacent ones of said channeling means defining therebetween an aperture for enabling cooling fluid to flow through said aperture toward and onto objects on said conveyor means, wherein said aperture is on an axis parallel to the direction of motion of said conveyor means, each said channeling means defining with said conveyor means a channel for receiving cooling fluid that has passed through an aperture onto said objects and for enabling said cooling fluid to flow into one or more of said regions;

(D) duct means for enabling flow of cooling fluid from one or more of said regions to said refrigeration means;

(E) passage means in fluid communication with an aperture and extending from said aperture into or across one of said regions, for enabling cooling fluid that enters said passage means from said aperture to enter said duct means after having flowed out of said passage means toward and onto said objects; and (F) fan means for causing flow of said cooling fluid from said refrigeration means through an aperture with sufficient velocity to impinge upon and cool said objects and to recirculate said cooling fluid through said duct means to said refrigeration means.

2. A cooling tunnel according to claim 1 wherein the conveyor means has openings therein permitting cooling fluid to pass therethrough.

3. A cooling tunnel according to claim 2 comprising a plurality of impingement section means located on opposite sides from each other of the conveyor means.

4. A cooling tunnel according to claim 3 wherein the distance from the impingement section means and the passage means to the conveyor means can be adjusted.

5. A cooling tunnel according to claim 1 wherein said passage means extends completely across one of said regions.

6. A cooling tunnel according to claim 5 comprising at least a pair of impingement section means and a region along the length of said conveyor means between said pair of impingement section means along which no impingement section means extends, and wherein said passage means is in fluid communication with apertures in both of said pair of impingement section means.

7. A cooling tunnel according to claim 6 wherein each of said pair of impingement section means has the same number of apertures and there is a plurality of passage means equal in number to said number of apertures, wherein each of said passage means is in fluid communication with one aperture in each of said pair of impingement section means.

8. A cooling tunnel according to claim 1 wherein the distance from the impingement section means and the passage means to the conveyor means can be adjusted.

9. A cooling tunnel according to claim 1 further comprising retention means for inhibiting product on said conveyor means in said region from being moved by flow of said cooling fluid.

10. A cooling tunnel according to claim 1 wherein said cooling fluid is air.

* * * * *